US010752462B2

(12) United States Patent
Aono

(10) Patent No.: US 10,752,462 B2
(45) Date of Patent: Aug. 25, 2020

(54) SHEET PROCESSING DEVICE AND IMAGE FORMING APPARATUS

(71) Applicant: KYOCERA Document Solutions Inc., Osaka (JP)

(72) Inventor: Shinya Aono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/252,094

(22) Filed: Jan. 18, 2019

(65) Prior Publication Data

US 2019/0225452 A1 Jul. 25, 2019

(30) Foreign Application Priority Data

Jan. 23, 2018 (JP) ..... 2018-008666

(51) Int. Cl.
*B65H 37/04* (2006.01)
*B65H 5/06* (2006.01)
*B27F 7/21* (2006.01)

(52) U.S. Cl.
CPC ..... *B65H 37/04* (2013.01); *B27F 7/21* (2013.01); *B65H 5/062* (2013.01); *B65H 2301/51611* (2013.01); *B65H 2408/12* (2013.01); *B65H 2801/06* (2013.01); *B65H 2801/27* (2013.01)

(58) Field of Classification Search
CPC ..... B65H 5/062; B65H 37/04; B65H 2301/51611; B65H 2408/12; B65H 2801/06; B65H 2801/27; B27F 7/21
USPC ..... 270/58.08
See application file for complete search history.

(56) References Cited

U.S. PATENT DOCUMENTS 7,240,817 B2 * 7/2007 Higuchi ..... B25C 5/1689 227/110
7,396,008 B2 * 7/2008 Sato ..... B27F 7/006 227/78
7,472,899 B2 * 1/2009 Moriyama ..... B65H 35/008 270/58.08
2006/0017210 A1 * 1/2006 Sato ..... B27F 7/006 270/58.08
2017/0173817 A1 * 6/2017 Shimizu ..... B27F 7/19

FOREIGN PATENT DOCUMENTS

JP 2006-35452 A 2/2006

* cited by examiner

*Primary Examiner* — Leslie A Nicholson, III
(74) *Attorney, Agent, or Firm* — Stein IP, LLC

(57) ABSTRACT

A sheet processing device includes a stapling unit that cuts off excess parts of a staple at a normal processing position, a container that stores the excess parts, the container having an upper end portion with an opening and being disposed below the stapling unit, a pair of electrodes disposed at a portion of a side wall of the upper end portion, the portion corresponding to the normal processing position, the pair of electrodes being exposed to inside the container, and a control unit for detecting that the excess parts in the container have reached the upper end portion when the pair of electrodes is short-circuited.

7 Claims, 9 Drawing Sheets

SHEET PROCESSING DEVICE AND IMAGE FORMING APPARATUS

INCORPORATION BY REFERENCE

This application is based upon and claims the benefit of priority from the corresponding Japanese Patent Application No. 2018-008666 filed Jan. 23, 2018, the entire contents of which are hereby incorporated by reference.

BACKGROUND

The present disclosure relates to a sheet processing device that performs stapling processing on a bundle of sheets, and an image forming apparatus.

Conventionally, there is a sheet processing device that performs stapling processing on a bundle of sheets. The conventional sheet processing device performs a process of cutting excess parts of staples as one process in the stapling processing. The cut excess parts of staples are stored in a container.

In addition, the conventional sheet processing device counts the number of performing times of the stapling processing so as to detect that the container is full when the count value exceeds a predetermined value. Further, the conventional sheet processing device displays a warning message when the container becomes full.

SUMMARY

A sheet processing device according to a first aspect of the present disclosure includes a stapling unit, a container, a pair of electrodes, and a control unit. The stapling unit performs stapling processing in which a staple is driven into a bundle of sheets at a predetermined normal processing position, excess parts of the staple are cut off, and the staple from which the excess parts are cut off is bent. The container has an upper end portion with an opening formed that receives the excess parts. The container is disposed below the stapling unit so that the opening faces the stapling unit. The container stores the excess parts that are cut off by the stapling unit and drop from the stapling unit. The pair of electrodes is disposed at a portion of a side wall of the upper end portion, the portion corresponding to the normal processing position, the pair of electrodes being exposed to inside the container. The control unit detects whether or not the pair of electrodes is short-circuited, so as to detect that the excess parts deposited inside the container have reached the upper end portion when the pair of electrodes is short-circuited.

An image forming apparatus according to a second aspect of the present disclosure includes the sheet processing device described above.

DETAILED DESCRIPTION

<Overall Structure of Multifunction Peripheral>

Figure 1:
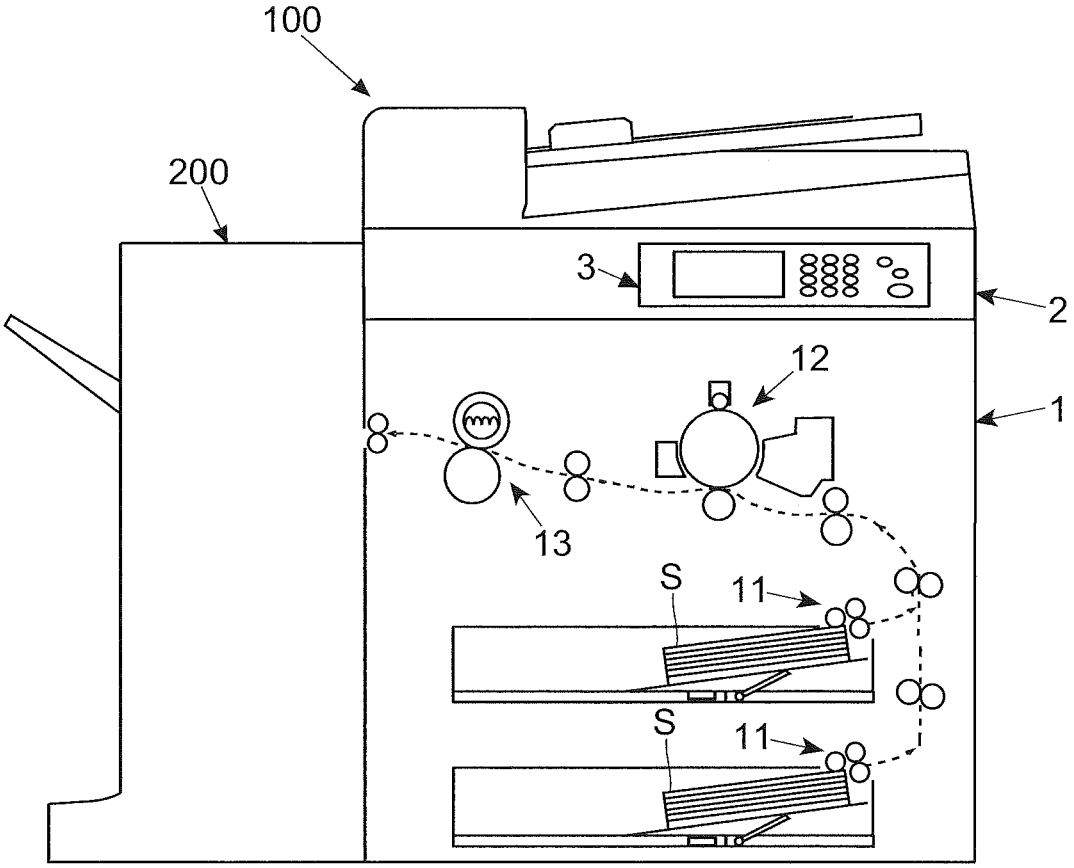
FIG. 1 is a schematic diagram illustrating an overall structure of a multifunction peripheral including a post-processing device according to an embodiment of the present disclosure.

As illustrated in FIG. 1, a multifunction peripheral 100 of this embodiment includes a printing portion 1 and an image reading portion 2. The multifunction peripheral 100 corresponds to an "image forming apparatus".

The printing portion 1 conveys a sheet S such as plain paper along a sheet conveying path (shown by broken lines in FIG. 1). In addition, the printing portion 1 forms a toner image based on image data of an image to be printed (e.g. image data of a document read by the image reading portion 2). Further, the printing portion 1 transfers the toner image onto the sheet S that is being conveyed. The printing portion 1 includes a sheet supply portion 11 that supplies the sheet S stored in a sheet cassette to the sheet conveying path, an image forming portion 12 that forms a toner image and transfers it onto the sheet S, and a fixing portion 13 that fixes the toner image transferred onto the sheet S to the sheet S.

The image reading portion 2 optically reads a document so as to generate image data of the document. The image reading portion 2 includes a light source and an image sensor. The light source irradiates the document with light. The image sensor receives reflection light reflected by the document and performs photoelectric conversion.

In addition, the multifunction peripheral 100 includes an operation panel 3. The operation panel 3 is provided with a touch screen and hardware buttons. The touch screen display software buttons and messages, and it receives various settings from a user. For instance, when performing a print job with stapling processing in which an end portion of a bundle of sheets is stapled, the operation panel 3 receives setting of a stapling position designated by the user.

Further, a post-processing device 200 is attached to the multifunction peripheral 100. The post-processing device 200 corresponds to a "sheet processing device". The multifunction peripheral 100 equipped with the post-processing device 200 conveys the printed sheet S to the post-processing device 200 when performing the print job. The post-processing device 200 performs post-processing such as punching processing or stapling processing on the printed sheet S.

Figure 2:
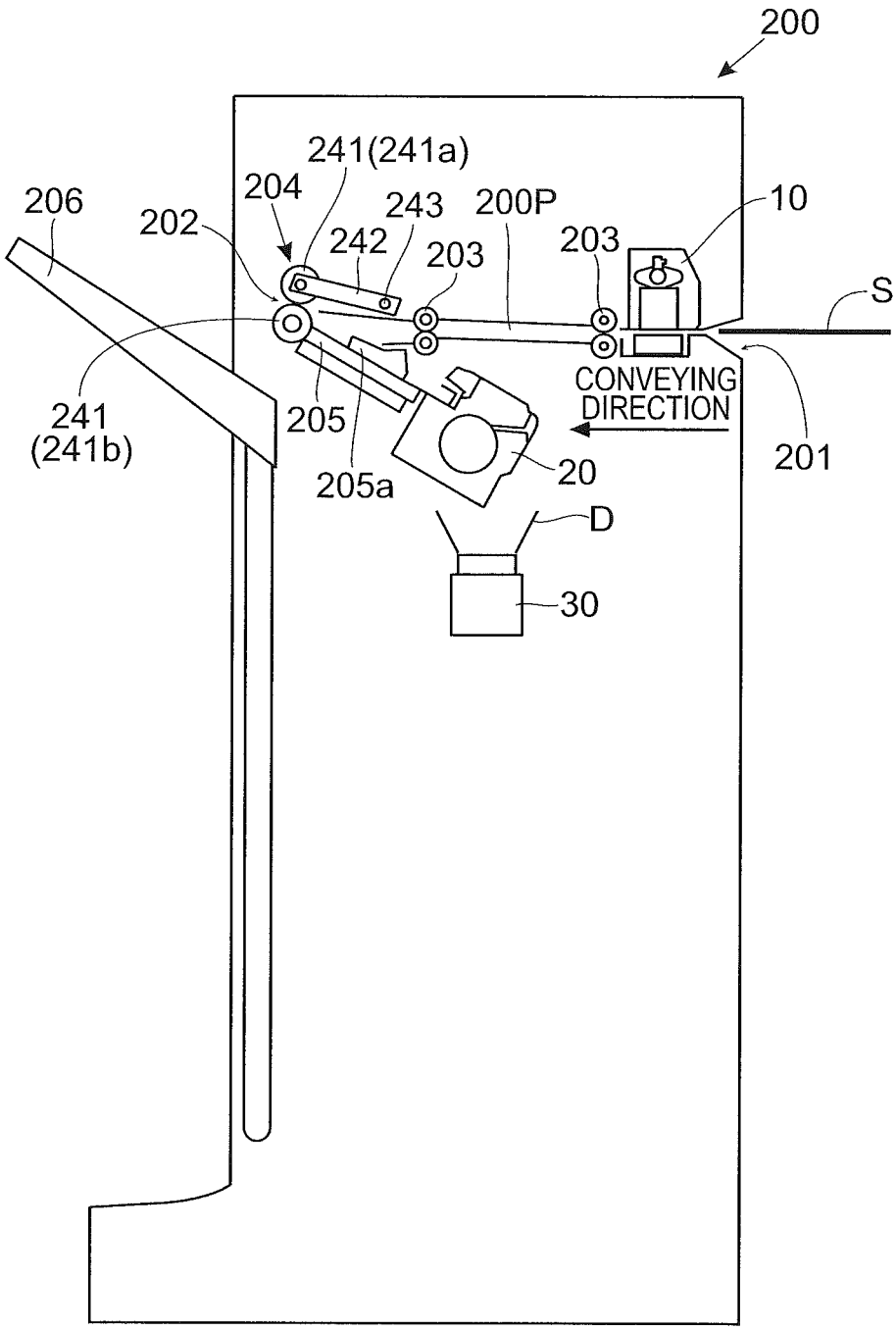
FIG. 2 is a schematic diagram illustrating a structure of the post-processing device according to an embodiment of the present disclosure.

As illustrated in FIG. 2, the post-processing device 200 has an inlet 201 for taking in the sheet S and a discharging outlet 202 for discharging the sheet S. Further, the post-processing device 200 conveys the sheet S taken in through the inlet 201 along a sheet conveying path 200P and performs the post-processing on the sheet S, and then discharges the sheet S through the discharging outlet 202. Note that the post-processing device 200 is provided with a plurality of conveying roller pairs 203 for conveying the sheet S along the sheet conveying path 200P. In addition, the post-processing device 200 is provided with a discharging portion 204 for discharging the sheet S through the discharging outlet 202.

In addition, the post-processing device 200 is provided with a punching unit 10 and a stapling unit 20. The punching unit 10 performs punching processing on the sheet S. The stapling unit 20 performs stapling processing on a bundle of sheets placed on a processing tray 205 (a bundle of the sheets S). The stapling unit 20 performs the stapling processing generally in a state where a center position of the bundle of sheets in a width direction (perpendicular to the sheet conveying direction) matches a predetermined reference position (e.g. a center position in a width direction of the processing tray 205).

Figure 3:
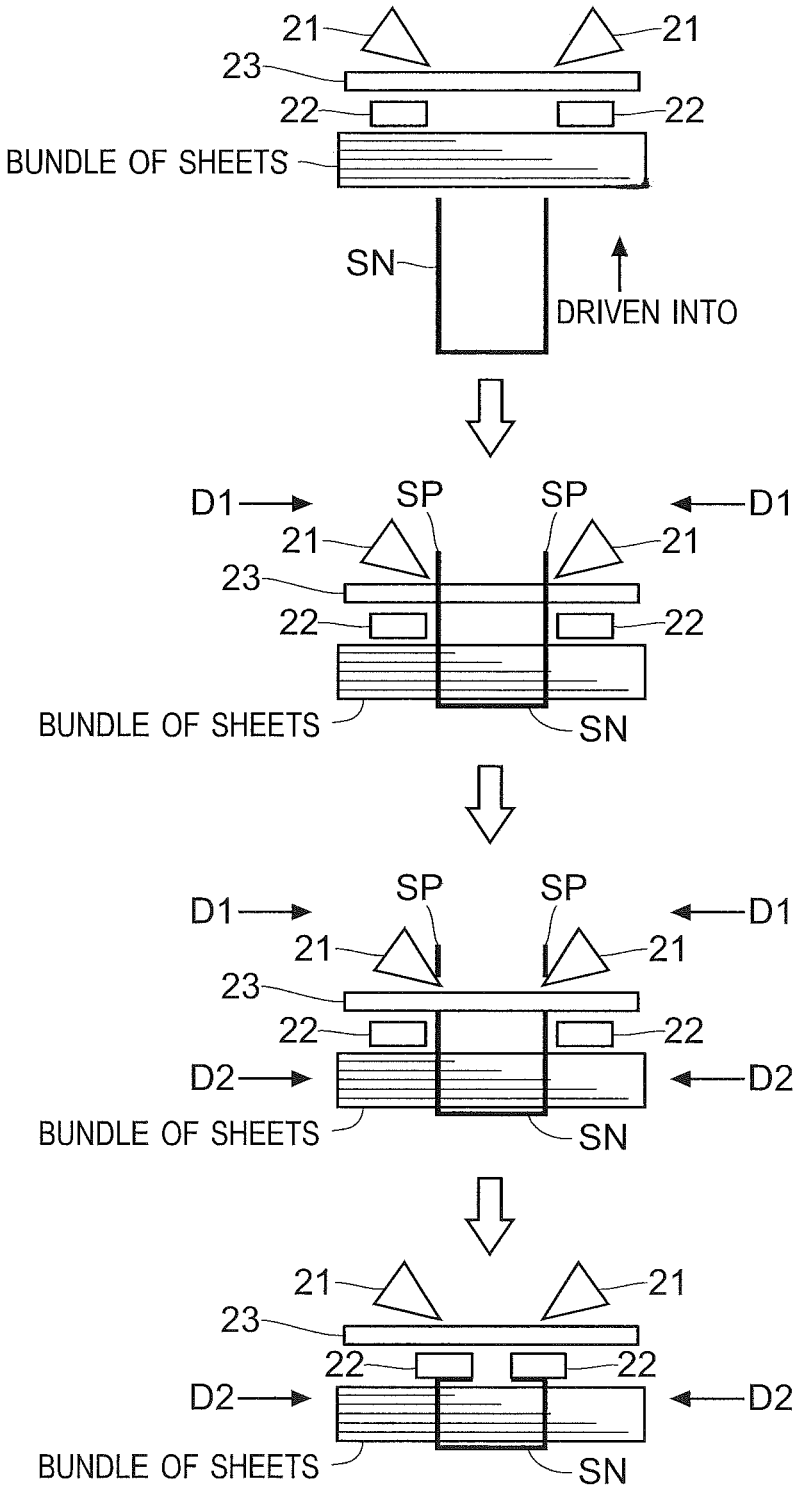
FIG. 3 is a diagram for explaining stapling processing performed by a stapling unit of the post-processing device according to an embodiment of the present disclosure.

As illustrated in FIG. 3, the stapling unit 20 includes a cutting member 21 and a clinching member 22. The cutting member 21 cuts off a staple SN. The clinching member 22 bends the staple SN.

When performing the stapling processing, the stapling unit 20 first drives the staple SN into the bundle of sheets (see the first and second parts from the top in FIG. 3). The staple SN is driven upward from below.

Next, the stapling unit 20 moves the cutting member 21 so as to cut off excess parts SP of the staple SN (see the second and third parts in FIG. 3). In this case, the cutting member 21 moves in arrow D1 direction in the diagram. A part of the staple SN protruding upward from a guide plate 23 (this part is the excess part SP) is cut off by the cutting member 21. As the number of sheets S forming the bundle of sheets is larger, the excess part SP is shorter. As the number of sheets S forming the bundle of sheets is smaller, the excess part SP is longer. In other words, when the stapling processing is performed on a bundle of two sheets, the excess part SP has the largest length.

After cutting off the excess parts SP of the staple SN, the stapling unit 20 moves the clinching member 22 to bend the staple SN from which the excess parts SP are cut off (see the third and fourth parts in FIG. 3). In this case, the clinching member 22 moves in arrow D2 direction in the diagram. In this way, the bundle of sheets is bound at the end portion by the staple SN.

Figure 4:
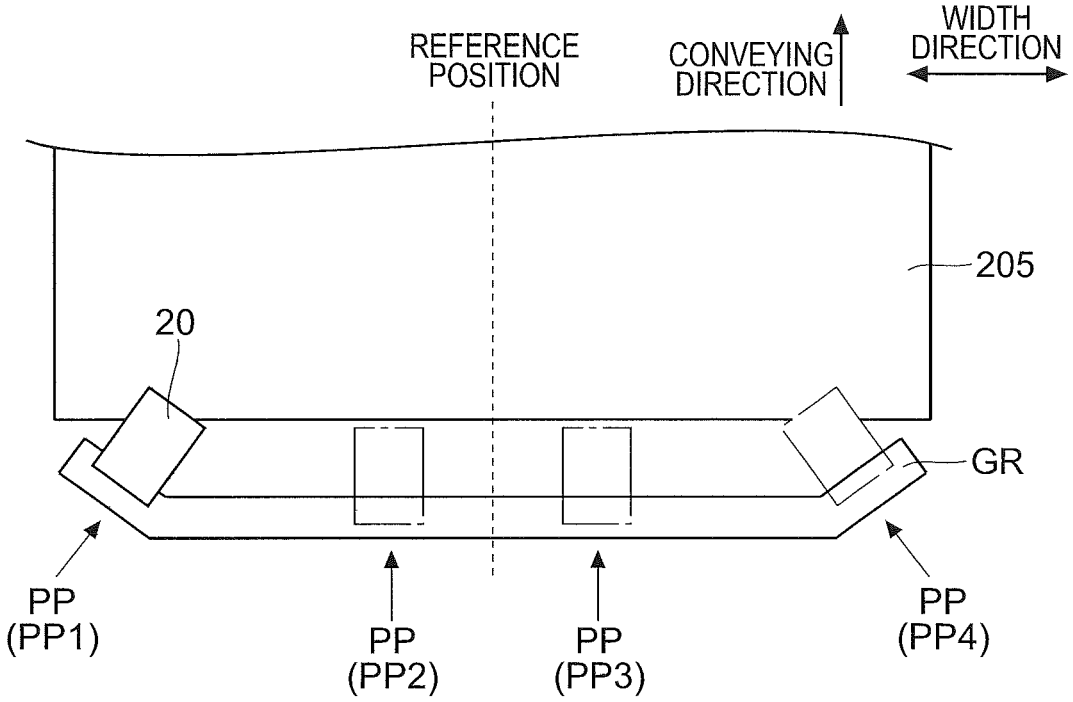
FIG. 4 is a diagram illustrating a processing position of the stapling processing performed by the stapling unit of the post-processing device according to an embodiment of the present disclosure.

As illustrated in FIG. 4, the stapling unit 20 can move in a direction parallel to a surface of the processing tray 205 on which the sheets are placed. For instance, the stapling unit 20 is supported by a guide rail GR in a slidable manner and moves in an extending direction of the guide rail GR.

The stapling unit 20 waits at a predetermined initial position on the guide rail GR until the print job with stapling processing is started. Further, when the print job with stapling processing is started, the stapling unit 20 moves to one of predetermined normal processing positions PP (PP1, PP2, PP3 and PP4) as a position for performing the stapling processing. Note that one of the normal processing positions PP may be the initial position.

Figure 5:
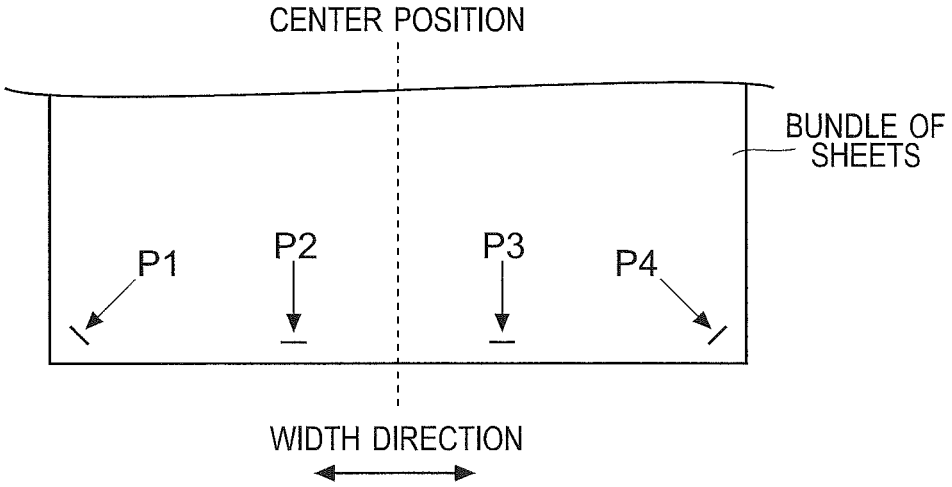
FIG. 5 is a diagram illustrating a stapling position of a bundle of sheets to be processed in the stapling processing by the stapling unit of the post-processing device according to an embodiment of the present disclosure.

For instance, if a position P1 shown in FIG. 5 (a point on the left end portion of the bundle of sheets) is the stapling position designated by the user, the stapling unit 20 moves to the normal processing position PP1 (see FIG. 4) so as to perform the stapling processing. If positions P2 and P3 shown in FIG. 5 (two points in the middle of the end portion of the bundle of sheets) are the stapling positions designated by the user, the stapling unit 20 moves to the normal processing position PP2 (see FIG. 4) so as to perform the stapling processing, and then moves to the normal processing position PP3 (see FIG. 4) so as to perform the stapling processing. If a position P4 shown in FIG. 5 (a point on the right end portion of the bundle of sheets) is the stapling position designated by the user, the stapling unit 20 moves to the normal processing position PP4 (see FIG. 4) so as to perform the stapling processing.

Further, as illustrated in FIG. 2, the processing tray 205 is inclined in a diagonally downward direction from one end side (discharging outlet 202 side) to the other end side. Further the stapling unit 20 is also inclined in the same manner as the processing tray 205 so as to perform the stapling processing on the bundle of sheets placed on the processing tray 205. In this structure, the excess part SP of the staple SN cut off by the stapling unit 20 falls by its own weight. As a variation, the stapling unit 20 may be provided with a mechanism that forces the excess part SP cut off from the staple SN to drop.

A storage container 30 is disposed below the stapling unit 20 so as to store the excess parts SP dropped from the stapling unit 20. The storage container 30 corresponds to a "container". The storage container 30 is disposed in a manner attachable to and detachable from the post-processing device 200. When the storage container 30 is detached from the post-processing device 200, the excess parts SP stored in the storage container 30 can be discarded.

Figure 6:
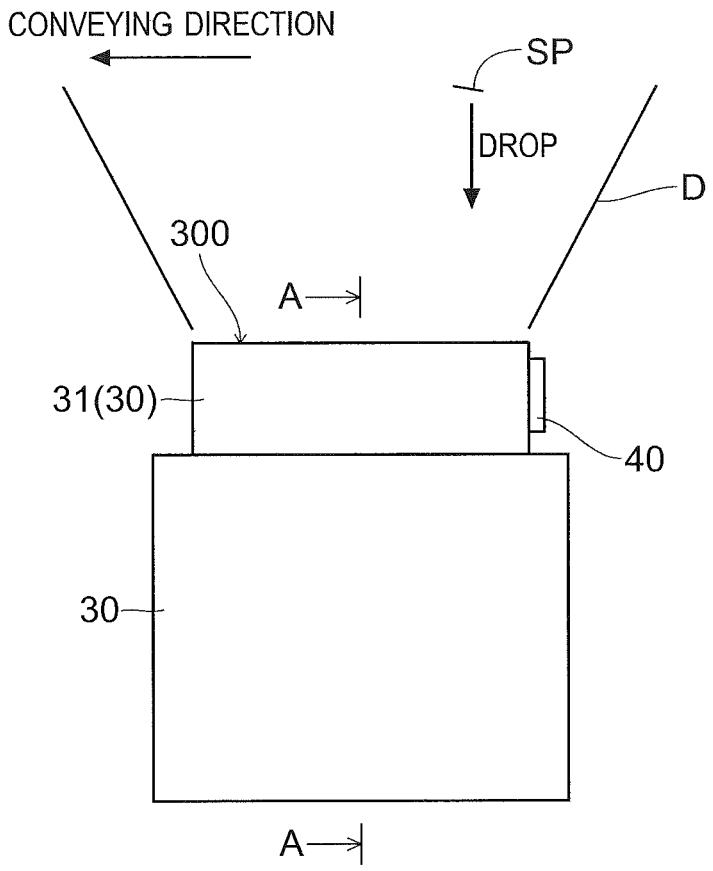
FIG. 6 is a diagram illustrating a structure of a storage container disposed in the post-processing device according to an embodiment of the present disclosure.

As illustrated in FIG. 6, the storage container 30 includes a duct portion 31 with an opening 300 that receives the excess parts SP dropped from the stapling unit 20. The duct portion 31 corresponds to an "upper end portion". In addition, a duct D is disposed between the stapling unit 20 and the storage container 30 so as to prevent the excess parts SP dropped from the stapling unit 20 from scattering.

Further, the post-processing device 200 includes a detection board 40 that detects an internal state of the storage container 30 (a deposited state of the excess parts SP). The detection board 40 corresponds to a "circuit board". The detection board 40 is disposed outside a side wall of the duct portion 31 of the storage container 30, i.e. in a vicinity of the opening 300 of the storage container 30. In a state where the storage container 30 is attached to the post-processing device 200, a mount surface of the detection board 40 contacts with an outer surface of the side wall of the duct portion 31.

Figure 7:
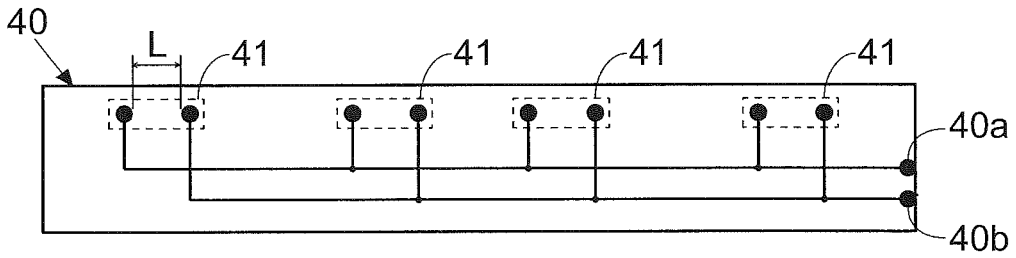
FIG. 7 is a diagram illustrating a structure of a detection board disposed in the post-processing device according to an embodiment of the present disclosure.

As illustrated in FIG. 7, the detection board 40 includes a pair of electrodes 41. A distance L between the pair electrodes 41 is wider than the maximum length of the excess parts SP. In addition, the detection board 40 includes a first connection terminal 40*a* and a second connection terminal 40*b*. One of the electrodes 41 is connected to the first connection terminal 40*a* via wiring on the detection board 40, and the other of the electrodes 41 is connected to the second connection terminal 40*b* via wiring on the detection board 40. The number of pairs of electrodes 41 is the same as the number of the normal processing positions PP. In other words, a plurality of pairs of electrodes 41 are disposed on the detection board 40.

Figure 8:
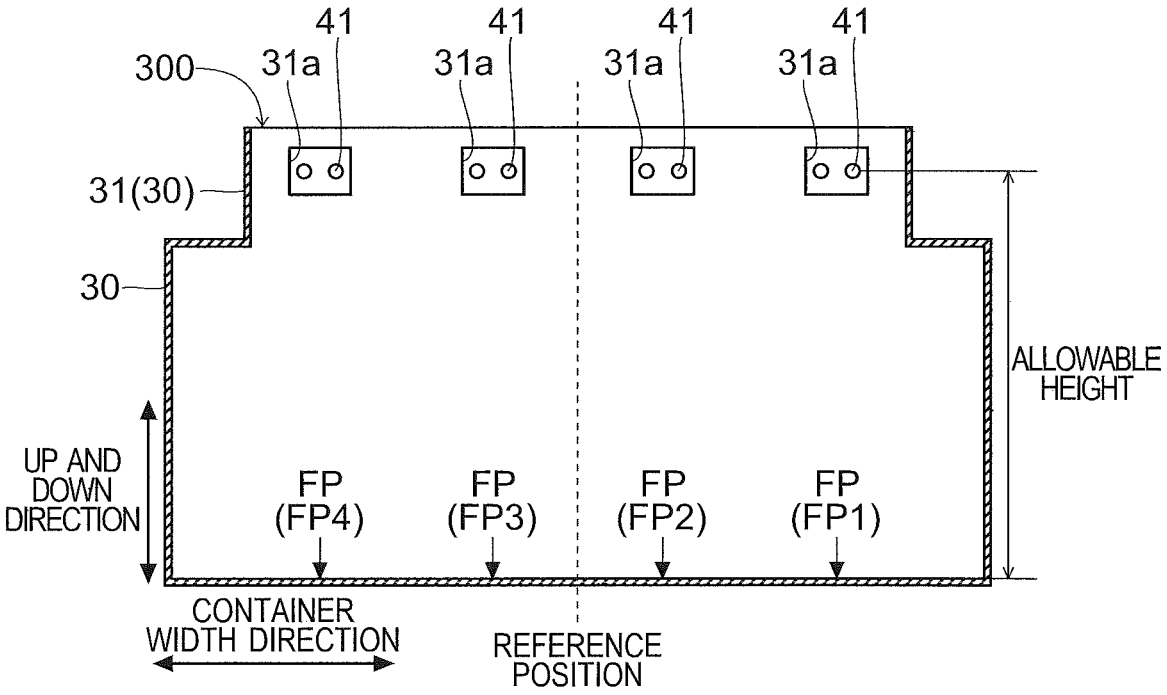
FIG. 8 is a cross-sectional view taken along A-A line in FIG. 6.

For instance, as illustrated in FIG. 8, a plurality of drop predicted positions FP (FP1, FP2, FP3 and FP4) corresponding respectively to the plurality of normal processing positions PP (PP1, PP2, PP3 and PP4) are predetermined by a manufacturer. The drop predicted position FP is a position in the storage container 30 at which the excess parts SP are predicted to drop when the stapling unit 20 performs the stapling processing. In FIG. 8, symbol FP1 denotes a drop predicted position FP of the excess parts SP when the stapling processing is performed at the normal processing position PP1, symbol FP2 denotes a drop predicted position FP of the excess parts SP when the stapling processing is performed at the normal processing position PP2, symbol FP3 denotes a drop predicted position FP of the excess parts SP when the stapling processing is performed at the normal processing position PP3, and symbol FP4 denotes a drop predicted position FP of the excess parts SP when the stapling processing is performed at the normal processing position PP4.

Further, the pair of electrodes 41 is disposed at each of the plurality of portions corresponding to the plurality of drop predicted positions FP. In other words, the pair of electrodes 41 is disposed at each of the plurality of portions corresponding to the plurality of normal processing positions PP. Each of the plurality of pairs of electrodes 41 is disposed so that its position in a container width direction perpendicular to the up and down direction of the storage container 30 matches the corresponding normal processing position PP (drop predicted position FP).

In addition, a hole 31*a* penetrating the side wall of the duct portion 31 of the storage container 30 in a thickness direction is formed at each of the plurality of portions (at which the pair of electrodes 41 is disposed) facing the plurality of pairs of electrodes 41. Thus, each of the plurality of pairs of electrodes 41 is exposed to inside of the storage container 30 through the hole 31*a* of the duct portion 31.

With reference to FIG. 2 again, the processing tray 205 includes a shift guide 205*a* that can move in the width direction perpendicular to the sheet conveying direction. This can shift the sheets S placed on the processing tray 205 in the width direction. For instance, when the stapling unit 20 performs the stapling processing, the center position in the width direction of the bundle of sheets can be shifted from the reference position.

The discharging outlet 202 side of the processing tray 205 is provided with a discharge roller pair 241 (an upper roller 241*a* and a lower roller 241*b*) for discharging the sheet S through the discharging outlet 202. The upper roller 241*a* is connected to one end of an arm 242, and the other end of the arm 242 is connected to a rotation shaft 243. When the one end of the arm 242 is rotated upward about the rotation shaft 243, the upper roller 241*a* is moved upward. In this case, the upper roller 241*a* is separated from the lower roller 241*b*. When the one end of the arm 242 is rotated downward about the rotation shaft 243, the upper roller 241*a* moves downward. In this case, the upper roller 241*a* approaches to the lower roller 241*b*.

In order to place the sheet S on the processing tray 205, the upper roller 241*a* is separated from the lower roller 241*b* to allow the front end of the sheet S to enter between the upper roller 241*a* and the lower roller 241*b*. After that, for example, a paddle (not shown) shifts the sheet S in a diagonally downward direction along the processing tray 205 (or the sheet S is shifted by its weight).

When discharging the sheet S placed on the processing tray 205 (including a bundle of sheets bound by the staple SN), the upper roller 241*a* is made to approach the lower roller 241*b* so that the sheet S is sandwiched between the upper roller 241*a* and the lower roller 241*b*, and the upper roller 241*a* and the lower roller 241*b* are rotated. In this way, the sheet S placed on the processing tray 205 is discharged onto the discharge tray 206 through the discharging outlet 202.

Figure 9:
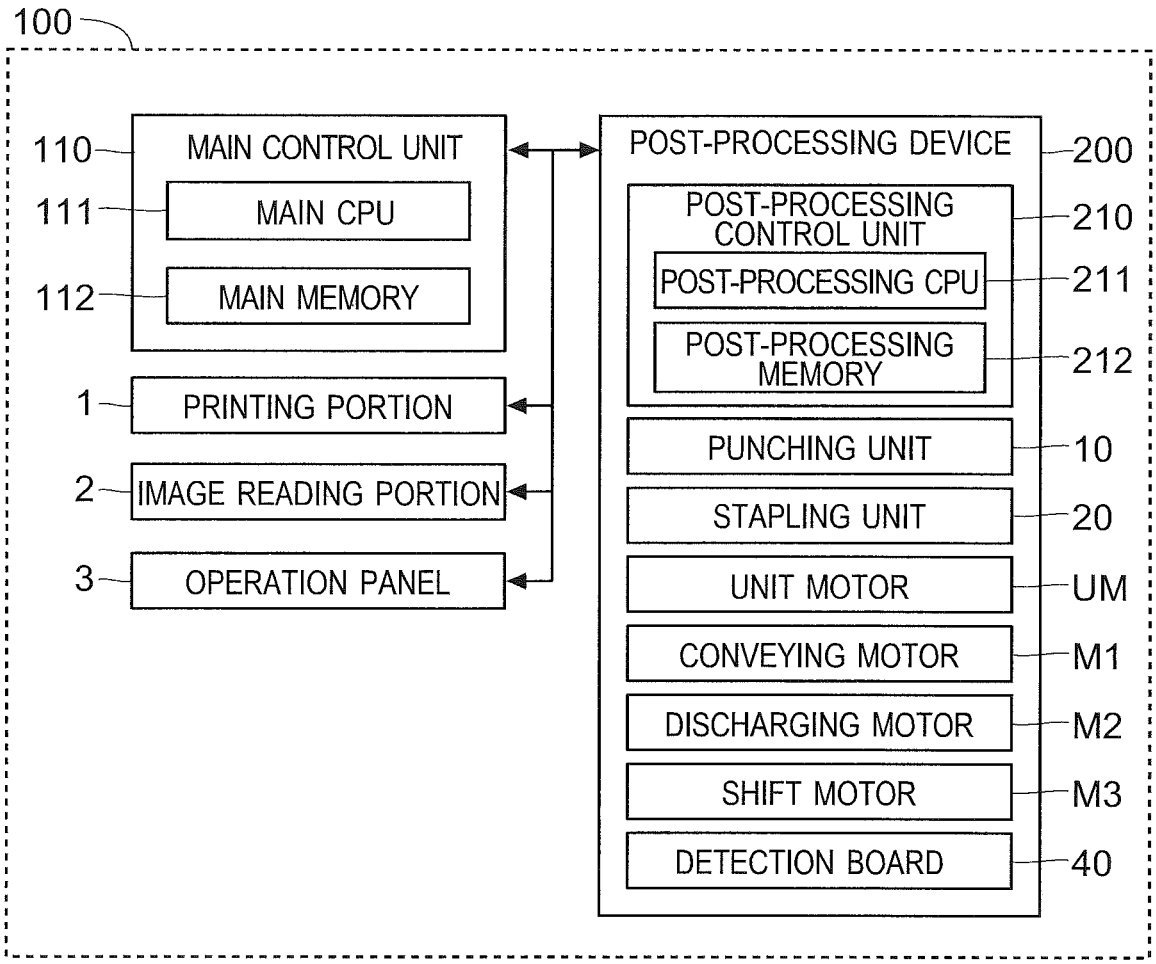
FIG. 9 is a block diagram illustrating an overall structure of the post-processing device according to an embodiment of the present disclosure.

In addition, as illustrated in FIG. 9, the multifunction peripheral 100 includes a main control unit 110. The main control unit 110 includes a main CPU 111 and a main memory 112 (a ROM and a RAM). The main control unit 110 controls individual portions of the multifunction peripheral 100 based on a control program and control data.

The main control unit 110 is connected to the printing portion 1 and the image reading portion 2 so as to control the printing portion 1 to perform printing operation and the image reading portion 2 to perform reading operation. In addition, the main control unit 110 is connected to the operation panel 3. Further, the main control unit 110 controls the operation panel 3 to perform display operation and detects an operation made to the operation panel 3.

The post-processing device 200 includes a post-processing control unit 210. The post-processing control unit 210 corresponds to a "control unit". The post-processing control unit 210 includes a post-processing CPU 211 and a post-processing memory 212. The post-processing control unit 210 is connected to the main control unit 110 in a communicable manner. The post-processing control unit 210 receives an instruction from the main control unit 110 and controls the post-processing device 200 to perform the post-processing operation based on a control program and control data. Note that the main control unit 110 may control the post-processing device 200 to perform the post-processing operation. In this case, the main control unit 110 functions as the "control unit".

The post-processing control unit 210 is connected to the punching unit 10 so as to control the punching unit 10 to perform operation. In addition, the post-processing control unit 210 is connected to the stapling unit 20 so as to control the stapling unit 20.

As to the print job with stapling processing, the main control unit 110 notifies the post-processing control unit 20 about the stapling position designated by the user when performing the job. When receiving the notice, the post-processing control unit 210 moves the stapling unit 20 to the normal processing position PP corresponding to the stapling position designated by the user among the plurality of normal processing positions PP, as one process in a preparation process for the print job with stapling processing. The post-processing control unit 210 is connected to a unit motor UM and control the unit motor UM, so as to move the stapling unit 20 along the guide rail GR.

In addition, the post-processing control unit 210 is connected to a conveying motor M1, a discharging motor M2, and a shift motor M3. The post-processing control unit 210 controls the conveying motor M1, the discharging motor M2, and the shift motor M3.

The post-processing control unit 210 controls the conveying motor M1 so that the conveying roller pair 203 is appropriately rotated. In addition, the post-processing control unit 210 controls the discharging motor M2 so that the discharge roller pair 241 is appropriately rotated. In addition, the post-processing control unit 210 controls the shift motor M3 so that the shift guide 205*a* of the processing tray 205 is appropriately moved in the width direction.

In addition, the post-processing control unit 210 performs a state detection process to detect an internal state of the storage container 30 using the detection board 40. For instance, the first connection terminal 40*a* of the detection board 40 (see FIG. 7) is connected to a power supply, and the second connection terminal 40*b* is connected to ground via a resistor. The post-processing control unit 210 is connected to the second connection terminal 40*b* of the detection board 40. Further, in the state detection process performed by the post-processing control unit 210, it is detected whether or not there is a short-circuited pair of electrodes 41 among the plurality of pairs of electrodes 41. In addition, the post-processing control unit 210 determines whether or not to perform a state notification process for notifying the user about a state inside the storage container 30 based on a result of the state detection process.

<State Detection Process and State Notification Process>

Figure 10:
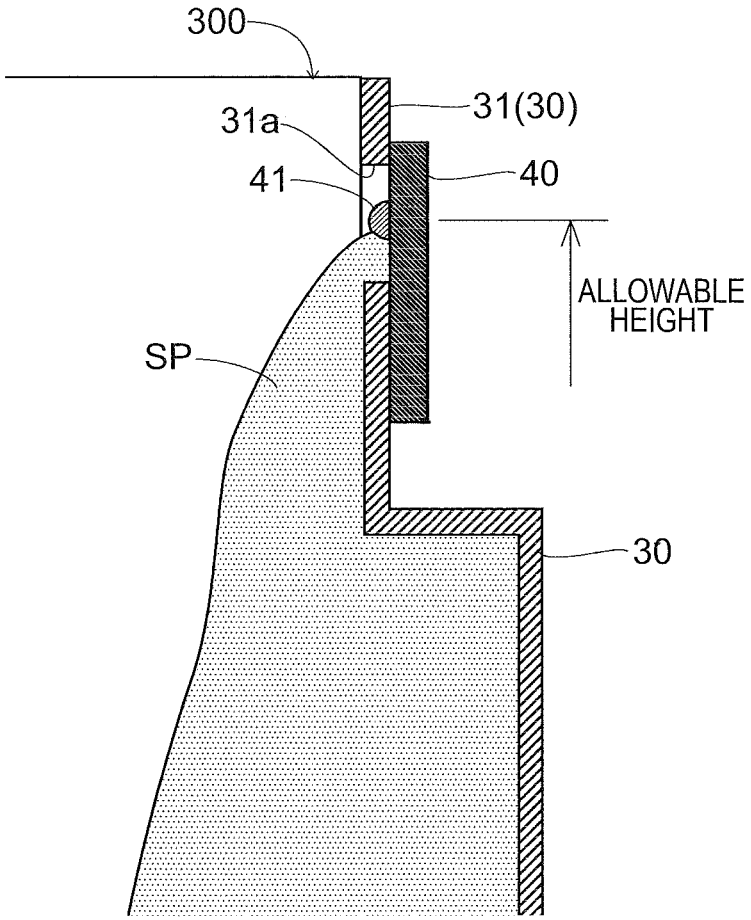
FIG. 10 is a diagram illustrating a state in which excess parts of staples stored in the storage container of the post-processing device according to an embodiment of the present disclosure have reached close to an opening of the storage container.

As illustrated in FIG. 10, there is a case where the excess parts SP deposited inside the storage container 30 reaches a vicinity of the opening 300 although the storage container 30 is not full. For instance, if the stapling processing has been performed frequently at one particular normal processing position PP among the plurality of normal processing positions PP so that the excess parts SP has been deposited inside the storage container 30 in such a manner that the deposition of the excess parts SP is not leveled, then the state illustrated in FIG. 10 occurs. In FIG. 10, the deposition of the excess parts SP is shown in a dotted pattern.

If a deposition height (from the bottom of the storage container 30) of the excess parts SP in the storage container 30 becomes higher than a predetermined allowable height, it may cause the excess parts SP to overflow from the opening 300 of the storage container 30 resulting in a malfunction. In addition, if a work of detaching the storage container 30 is performed in the state where the deposition height of the excess parts SP in the storage container 30 is higher than the allowable height, it may cause the excess parts SP to scatter inside the apparatus resulting in a malfunction.

Therefore, the post-processing control unit 210 performs the state detection process using the detection board 40. The post-processing control unit 210 performs the state detection process using the detection board 40, and thereby detects whether or not the excess parts SP deposited inside the storage container 30 have reached a vicinity of the opening 300 (whether or not the deposition height of the excess parts SP in the storage container 30 has reached the allowable height). In order to make the post-processing control unit 210 perform the detection, a distance in the up and down direction between the bottom of the storage container 30 and the position of the plurality of pairs of electrodes 41 is set to a value corresponding to the allowable height (see FIG. 8).

For instance, when the state illustrated in FIG. 10 occurs, the excess parts SP enter the hole 31*a* of the duct portion 31 of the storage container 30. Then, the excess parts SP contact with the pair of electrodes 41 corresponding to the hole 31*a* in which the excess parts SP enter (the pair of electrodes 41 is short-circuited).

In this case, the post-processing control unit 210 detects that one of the pairs of electrodes 41 is short-circuited. When this detection result is obtained, the post-processing control unit 210 detects that the excess parts SP have reached a vicinity of the opening 300 of the storage container 30 (the deposition height of the excess parts SP in the storage container 30 has reached the allowable height). When the post-processing control unit 210 detects that the excess parts SP have reached a vicinity of the opening 300 of the storage container 30, it performs the state notification process to notify the fact to the user.

Figure 11:
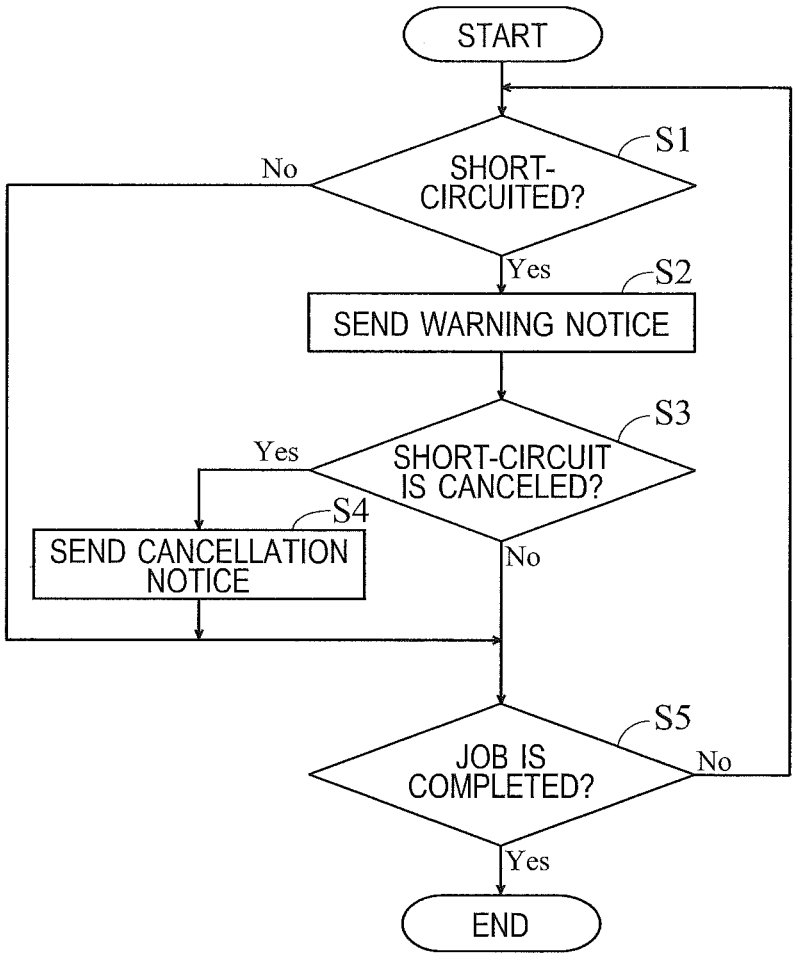
FIG. 11 is a flowchart showing a flow of a state detection process and a state notification process performed by a post-processing control unit of the post-processing device according to an embodiment of the present disclosure.

With reference to the flowchart shown in FIG. 11, the state detection process and the state notification process performed by the post-processing control unit 210 are described below.

Further, the excess parts SP to be stored in the storage container 30 are produced when performing the print job with stapling processing (including the print job with both stapling processing and punching processing). In other words, the state inside the storage container 30 is not changed when performing a job other than the print job with stapling processing (e.g. when performing a print job with only punching processing). For this reason, the flowchart shown in FIG. 11 starts when the print job with stapling processing is started.

In Step S1, the post-processing control unit 210 determines whether or not one of the pairs of electrodes 41 is short-circuited (whether or not there is a short-circuited pair of electrodes 41 among the plurality of pairs of electrodes 41). As a result, if the post-processing control unit 210 determines that one of the pairs of electrodes 41 is short-circuited, the process proceeds to Step S2.

In Step S2, the post-processing control unit 210 transmits to the main control unit 110 a warning notice indicating that there is a short-circuited pair of electrodes 41 among the plurality of pairs of electrodes 41. When receiving the warning notice, the main control unit 110 controls the operation panel 3 to display a warning message. For instance, the operation panel 3 displays a message informing that the storage container 30 will be full soon (a message informing a current state of the storage container 30) or a message urging to discard the excess parts SP in the storage container 30, as the warning message.

Note that the main control unit 110 continues the print job even when receiving the warning notice from the post-processing control unit 210. However, it may be possible to stop the print job when the warning notice is transmitted to the main control unit 110 from the post-processing control unit 210.

In Step S3, the post-processing control unit 210 determines whether or not the short-circuited state is canceled. As a result, if the post-processing control unit 210 determines that the short-circuited state is canceled, the process proceeds to Step S4. For instance, after one of the pairs of electrodes 41 becomes short-circuited, e.g. a vibration generated when the print job is executed may collapse the deposition of the excess parts SP so that the deposition is leveled (the excess parts SP contacting with one of the pairs of electrodes 41 may drop from the position of the pair of electrodes 41). In this case, the short-circuited state is canceled.

In Step S4, the post-processing control unit 210 transmits to the main control unit 110 a cancellation notice indicating that the short-circuited state is canceled. When receiving the cancellation notice, the main control unit 110 stops the display of the warning message on the operation panel 3. After that, the process proceeds to Step S5. Note that, if the post-processing control unit 210 determines that the short-circuited state is not canceled in Step S3, the process proceeds to Step S5 without performing Step S4 (the operation panel 3 continues to display the warning message).

In Step S5, the post-processing control unit 210 determines whether or not the print job is completed. As a result, if the post-processing control unit 210 determines that the print job is completed, this flow is finished. On the contrary, if the post-processing control unit 210 determines that the print job is not completed, the process proceeds to Step S1. The post-processing control unit 210 determines whether or not the print job is completed on the basis of whether or not it has received a completion notice transmitted from the main control unit 110 when the print job is completed.

In Step S1, if the post-processing control unit 210 determines that there is no short-circuited pair of electrodes 41, the process proceeds to Step S5.

If the print job is completed without the short-circuited state is canceled, the post-processing control unit 210 continues the state detection process also after the print job is completed. In addition, the main control unit 110 controls the operation panel 3 to continue the display of the warning message also after the print job is completed.

After the print job is completed without the short-circuited state is canceled, the user who notices the warning message will detach the storage container 30 from the post-processing device 200 in order to discard the excess parts SP in the storage container 30. In this case, the deposition of the excess parts SP in the storage container 30 is collapsed, and hence the short-circuited state is canceled, which is detected by the post-processing control unit 210. When detecting that the short-circuited state is canceled, the post-processing control unit 210 transmits the cancellation notice to the main control unit 110. Therefore, after the print job is completed without cancellation of the short-circuited state (while the warning message is displayed on the operation panel 3), when the user detaches the storage container 30 from the post-processing device 200, the display of the warning message on the operation panel 3 is stopped.

In the structure of this embodiment, as described above, the deposition of the excess parts SP deposited in a protruding shape in the storage container 30 is not leveled, and the excess parts SP are continuously deposited. When the excess parts SP reach a vicinity of the opening 300 of the storage container, the excess parts SP contact with the pair of electrodes 41 disposed at the duct portion 31 of the storage container 30 (at which the opening 300 is formed). In other words, the pair of electrodes 41 becomes short-circuited. Further, the post-processing control unit 210 detects whether or not the pair of electrodes 41 has become short-circuited. In this way, when the excess parts SP deposited inside the storage container 30 reach a vicinity of the opening 300, the post-processing control unit 210 can securely detect that the excess parts SP has reached a vicinity of the opening 300 of the storage container 30.

In addition, as described above, in this embodiment, the pair of electrodes 41 is disposed in each of the plurality of portions corresponding to the plurality of normal processing positions PP on the side wall of the duct portion 31 of the storage container 30. In this structure, even if there are plurality of positions in the storage container 30 at with the excess parts SP can be deposited in a protruding shape (i.e. even if there are a plurality of normal processing positions PP), when the excess parts SP deposited at one of the positions reaches a vicinity of the opening 300 of the storage container 30, this can be detected by the post-processing control unit 210.

In addition, as described above, in this embodiment, the distance between the pair electrodes 41 is wider than the maximum length of the excess parts SP of the staples SN. In this structure, for example, it is possible to prevent the excess part SP from being caught by the pair of electrodes 41. In this way, it is possible to prevent occurrence of an improper state in which the pair of electrodes 41 becomes short-circuited although a summit of the protruding deposition of the excess parts SP has not reached a vicinity of the opening 300 of the storage container 30 (it is possible to prevent misdetection).

In addition, as described above, in this embodiment, the pair of electrodes 41 is formed on the detection board 40 disposed outside of the side wall of the duct portion 31 of the storage container 30, and is exposed to inside of the storage container 30 through the hole 31*a* formed in the side wall of the duct portion 31. In this structure, although the detection board 40 is disposed outside of the storage container 30, when the excess parts SP reaches a vicinity of the opening 300 of the storage container 30, this can be detected by the post-processing control unit 210.

<Stapling Processing at Position Shifted from Normal Processing Position>

In a structure in which the stapling processing is performed only at the normal processing position PP, a protruding deposition (a deposition mountain generated when the excess parts SP are locally deposited) is likely formed in the storage container 30. In other words, the state illustrated in FIG. 10 is apt to occur. As a result, the user must frequently discard the excess parts SP.

The stapling unit 20 can perform the stapling processing also at a position shifted from the normal processing position PP. In this way, occurrence of the above-mentioned improper state can be prevented. Although not particularly limited, the stapling unit 20 can perform the stapling processing at positions on one side and the other side of the normal processing position PP shifted by a few mm each in the width direction.

For instance, after the stapling processing (on one bundle of sheets) at the normal processing position PP is finished, when performing the next stapling processing, the stapling unit 20 moves to a position shifted from the normal processing position PP. Then, the stapling unit 20 performs the stapling processing at the position shifted from the normal processing position PP. In other words, if the previous stapling processing is performed at the normal processing position PP, the stapling unit 20 performs the stapling processing of this time at the position shifted from the normal processing position PP. In this structure, if the stapling processing is sequentially performed on a plurality of bundles of sheets in one print job, the stapling unit 20 moves to change its position every time when the stapling processing on the bundle of sheets is finished (the stapling processing is not performed successively at the same position).

Alternatively, after the print job with stapling processing at the normal processing position PP is finished, when performing the next stapling processing, the stapling unit 20 moves to a position shifted from the normal processing position PP. Then, the stapling unit 20 performs the stapling processing at the position shifted from the normal processing position PP. In other words, if the stapling processing is performed at the normal processing position PP in the previous print job, the stapling unit 20 performs the stapling processing at the position shifted from the normal processing position PP in the print job of this time. In this structure, the stapling unit 20 moves to change its position every time when the print job with stapling processing is finished (the stapling processing in the print job of this time is not performed at the same position as the stapling processing in the previous print job).

Note that when the post-processing control unit 210 controls the stapling unit 20 to perform the stapling processing at a position shifted from the normal processing position PP, it moves the shift guide 205*a* of the processing tray 205 so that the center position in the width direction of the bundle of sheets placed on the processing tray 205 is shifted from the reference position (the bundle of sheets is shifted in the width direction).

For instance, if the stapling positions designated by the user are two positions in the middle of the end portion of the bundle of sheets, the stapling unit 20 moves to a position shifted from the normal processing position PP2 on one side (or the other side) in the width direction by a predetermined amount, and performs the stapling processing. After that, the stapling unit 20 moves a position shifted from the normal processing position PP3 on one side (or the other side) in the width direction by a predetermined amount, and performs the stapling processing.

In this case, when the stapling unit 20 performs the stapling processing, the post-processing control unit 210 shifts the bundle of sheets placed on the processing tray 205 to one side (or the other side) in the width direction by the same amount as the predetermined amount. In other words, the post-processing control unit 210 shifts the center position in the width direction of the bundle of sheets from the reference position. Then, in this state, the post-processing control unit 210 control the stapling unit 20 to perform the stapling processing. In this way, the bundle of sheets are bound by the staples SN at the stapling positions designated by the user (the two positions in the middle of the end portion of the bundle of sheets).

After the stapling processing (on a bundle of sheets) at the position shifted from the normal processing position PP is finished, when performing the next stapling processing, the stapling unit 20 moves to the normal processing position PP. Then, the stapling unit 20 performs the stapling processing at the normal processing position PP. Alternatively, after the print job with stapling processing at the position shifted from the normal processing position PP is finished, when performing the next stapling processing, the stapling unit 20 moves to the normal processing position PP. Then, the stapling unit 20 performs the stapling processing at the normal processing position PP.

In this structure, the stapling unit 20 does not perform the stapling processing repeatedly at the same position. In other words, drop positions of the excess parts SP dropping into the storage container 30 are dispersed. In this way, it is possible that the protruding deposition (a deposition mountain having a deposition height reaching the allowable height) is hardly generated in the storage container 30.

The embodiment described above is merely an example in every aspect and should not be understood as a limitation. The scope of the present disclosure is defined not by the above description of the embodiment but by the claims, and should be understood to include all modifications within the meaning and scope equivalent to the claims.

What is claimed is:

1. A sheet processing device comprising:

a stapling unit for performing a stapling processing in which a staple is driven into a bundle of sheets at a predetermined normal processing position, excess parts of the staple are cut off, and the staple from which the excess parts are cut off is bent;

a container having an upper end portion with an opening formed that receives the excess parts, the container being disposed below the stapling unit so that the opening faces the stapling unit, the container storing the excess parts cut off by the stapling unit to drop from the stapling unit;

a pair of electrodes disposed at a portion of a side wall of the upper end portion, the portion corresponding to the normal processing position, the pair of electrodes being exposed to inside the container; and a control unit for detecting whether or not the pair of electrodes is short-circuited, so as to detect that the excess parts deposited inside the container have reached the upper end portion when the pair of electrodes is short-circuited.

2. The sheet processing device according to claim 1, wherein the stapling unit performs the stapling processing at one of a plurality of the normal processing positions, and the pair of electrodes is disposed at each of portions corresponding respectively to the normal processing positions, on the side wall of the upper end portion.

3. The sheet processing device according to claim 1, wherein a distance between the pair electrodes is wider than a maximum length of the excess parts, and the maximum length is a length of the excess parts that arise when the stapling processing is performed on a bundle of two sheets.

4. The sheet processing device according to claim 1, wherein a hole is formed in the portion of the side wall of the upper end portion, at which the pair of electrodes is disposed, and the pair of electrodes is disposed on a circuit board disposed outside of the side wall of the upper end portion and is exposed to inside of the container through the hole.

5. The sheet processing device according to claim 1, wherein the stapling unit is capable of performing the stapling processing at a position shifted from the normal processing position, and after the stapling processing at the normal processing position is finished or after a job with the stapling processing at the normal processing position is finished, when performing a next stapling processing, the stapling unit performs the stapling processing at the position shifted from the normal processing position.

6. The sheet processing device according to claim 5, wherein the stapling unit is capable of performing the stapling processing at the position shifted from the normal processing position, and after the stapling processing at the position shifted from the normal processing position is finished or after a job with the stapling processing at the position shifted from the normal processing position is finished, when performing a next stapling processing, the stapling unit performs the stapling processing at the normal processing position.

7. An image forming apparatus comprising the sheet processing device according to claim 1.

* * * * *